US011365371B2

(12) United States Patent
Shulepov et al.

(10) Patent No.: US 11,365,371 B2
(45) **Date of Patent: *Jun. 21, 2022**

(54) USE OF POLYSACCHARIDE MICROGELS IN DETERGENTS

(71) Applicant: OBSHESTVO S OGRANICHENNOI OTVETSTVENNOST'U "BIOMICROGELI", Moscow (RU)

(72) Inventors: Il'ya Shulepov, Ekaterinburg (RU); Maksim Mironov, Ekaterinburg (RU); Andrey Elagin, Ekaterinburg (RU)

(73) Assignee: OBSHESTVO S OGRANICHENNOI OTVETSTVENNOST'U "BIOMICROGELI", Moscow (RU)

( * ) Notice: Subject to any disclaimer, the term of this patent is extended or adjusted under 35 U.S.C. 154(b) by 141 days.

This patent is subject to a terminal disclaimer.

(21) Appl. No.: 16/495,002

(22) PCT Filed: Aug. 23, 2017

(86) PCT No.: PCT/IB2017/055076

§ 371 (c)(1),
(2) Date: Sep. 17, 2019

(87) PCT Pub. No.: WO2018/185539

PCT Pub. Date: Oct. 11, 2018

(65) Prior Publication Data

US 2020/0032166 A1 Jan. 30, 2020

(30) Foreign Application Priority Data

Apr. 3, 2017 (RU) ..... 2017111137
May 10, 2017 (RU) ..... 2017116306

(51) Int. Cl.

| | |
|---|---|
| ***C11D 1/00*** | (2006.01) |
| ***C11D 3/22*** | (2006.01) |
| ***C11D 3/00*** | (2006.01) |
| ***C11D 9/26*** | (2006.01) |
| ***C11D 11/00*** | (2006.01) |

(52) U.S. Cl.

CPC ..... *C11D 3/0036* (2013.01); *C11D 3/0031* (2013.01); *C11D 3/225* (2013.01); *C11D 3/227* (2013.01); *C11D 9/262* (2013.01); *C11D 11/0023* (2013.01); *C11D 11/0035* (2013.01); *C11D 11/0052* (2013.01)

(58) Field of Classification Search

CPC ..... C11D 1/00; C11D 1/662; C11D 3/042; C11D 3/044; C11D 3/22; C11D 3/225; C11D 9/262

See application file for complete search history.

(56) References Cited

U.S. PATENT DOCUMENTS

| | | | | |
|---|---|---|---|---|
| 9,718,704 | B2 * | 8/2017 | Elagin | B01J 20/28047 |
| 10,414,960 | B2 * | 9/2019 | Elagin | B09C 1/00 |
| 10,550,301 | B2 * | 2/2020 | Elagin | B01J 20/28004 |
| 2010/0105600 | A1 * | 4/2010 | Guckenbiehl | C11D 3/225 510/471 |
| 2014/0317858 | A1 * | 10/2014 | Tan | C11D 11/04 510/446 |

FOREIGN PATENT DOCUMENTS

| | | | | |
|---|---|---|---|---|
| EP | 0189935 A2 | | 8/1986 | |
| JP | 2002/282677 | * | 10/2002 | A61K 9/107 |
| RU | 2147589 C1 | | 4/2000 | |
| RU | 2596751 | * | 9/2016 | B09C 1/00 |
| RU | 2596751 C1 | | 9/2016 | |

OTHER PUBLICATIONS

International Search Report for PCT Application No. PCT/IB2017/055076 dated Dec. 7, 2017.

* cited by examiner

*Primary Examiner* — Brian P Mruk
(74) *Attorney, Agent, or Firm* — Medler Ferro Woodhouse & Mills PLLC

(57) ABSTRACT

The proposed cluster of inventions relates to chemical industry, in particular to compositions of and additives in detergents designed for household, professional or personal use, to be used at home or industrially. The essence of this cluster of inventions lays in the use of polysaccharide microgels as an additive or the base in detergents, in particular as an antiresorption agent, thickener, or an agent for reducing surface tension at the interphase boundary, including also composition of detergents with polysaccharide microgels. The technological result of the application of these inventions is reduction of the quantity of surfactants in the detergent, while its detergency is no affected, which raises their ecological value and safety for the final users.

19 Claims, No Drawings

USE OF POLYSACCHARIDE MICROGELS IN DETERGENTS

This cluster of inventions relates to chemical industries, in particular to additives for detergents designed for home, professional or personal use.

Detergency of home and industrial detergents presents a comprehensive property on which ability of a detergent is based, its ability to return the dirtied surface to its initial clean state. Detergency is evaluated on the basis of the ability to fully remove contamination from the entire surface rather than for its contaminated area only. A good proper, relevant detergent should be able not only to remove a contamination from the surface but to keep the contaminants in solution and prevent their secondary precipitation of on the cleaned surface, i.e. e it should possess antiresorption function or a stabilizing effect. The most popular synthetic detergents possess a relatively low ability to arrest contaminants, allowing small particles to reprecipitate on fabric for instance, which makes the fabric grayish after it has been washed a few times. Secondary precipitation on cleaned hard surfaces (dishes, windows, cars) increases consumption of surface-active agents as the contaminated surface requires extra cleaning.

It also important that quality of detergents for the consumer is not limited to heir detergency (cleaning power). It also depends on being kind on the consumer's skin, its viscosity and foaming. High viscosity is a must for dish wash detergents, sanitary ware detergents, detergents for cleaning hard surfaces, for personal hygiene products, such as shampoos etc. This cuts down consumption of detergents, improves their uniform spreading on the surface and keeping them on the surface for a considerable time. Several methods can be used to thicken detergents. One of the methods used is adding polymers, such as carboxymethyl cellulose, polyvinyl chloride pyrrolidone, xanthan or guar gum. This method is not perfect because polymers are not surface-active, so that they become just an extra ingredient in the mixture, without contributing to the main purpose of detergents. Another method is using higher concentrations of surfactants or using surfactants that form liquid-crystal phases. In that case the surfactant itself acts as a thickener, however such a detergent contains either too much surfactants or else the surfactants used are expensive. Yet another, the most popular, method to increase viscosity is adding salts of—usually—sodium chloride. Surfactants become salted-out of the solution, forming viscous liquid-crystalline phases. This method makes detergents harsher more irritative for the skin, while also reducing their detergency.

Foaming capacity has little effect on detergency, but it promotes visual control of detergent consumption. Foaming is usually controlled by selection of appropriate surfactants or by polymer additives. Both have a detrimental effect on general consumption of surfactants because some quantity of them would be consumed by foaming.

As a consequence, detergents usually contain a large quantity of surfactants (15 to 30%), which can hurt pollute the environment and consumers in the process of application or afterwards. It needs to be understood that only a small fraction of surfactants is involved in binding contaminants, while most of their quantity is used for? the concentration up. Antiresorptive agents are added to detergents to reduce consumption of surfactants. Hydrophilic polymers used as such agents are carboxymethyl cellulose for cotton, or polyvinyl pyrrolidone for wool or silk fabrics, or else alkaline salts (soda ash, sodium tripolyphosphate, trisodium phosphate, hexametaphosphate or silicate), which improve emulsification capacity and colloidal structure of detergents, strengthen detergent films forming around foreign particles, thus reducing their precipitation rate on the surface.

There is a detergent with polysaccharides, where 5 to 95% of polysaccharides are represent water-soluble, unsubstituted hemicellulose [EP2336283A1, C11D3/00, and C11D3/22, published on 22 Jun. 2011].

There is also a detergent that contains washing powder and polysaccharide particles of 1-100 μm in size [US2016230124, C11D17/043, C11D17/06, C11D3/222, and C11D3/225, published on 11 Aug. 2016.

The following detergent containing one or several surfactants and an additive in the form of dry polysaccharide, less than 100 nm particle size, was chosen as the prototype for this invention: U.S. Pat. No. 7,842,658, MPC A61K8/73, C11D1/00, and C11D3/22, published on 30 Nov. 2010.

The drawback of the prototype the use of hydrophilic polymers in the form of fine powder, which form stable suspensions, as antiresorption agents. In this case, consumption rate of antiresorption agent was high, because its powder consisted almost entirely of polymers. Moreover, these particles have no sufficient affinity to the surface, forming loose, unstable layers on the surface, are no surfactants and represent an extra component in the solution, while not contributing to the main purpose of the detergent. Using the known detergent and the contained in it additive, it is possible to reduce consumption rate of surfactants in detergents.

The proposed cluster of inventions aims at improving ecological properties and the safety of detergents for the user.

The technological result of this cluster of inventions is reduction of the quantity of surfactants in detergents, while preserving their detergency.

This technological result is achieved by the use of polysaccharide microgels as the base or an additive in detergents and detergents for using such microgels.

Using polysaccharide microgels as an antiresorption agent for detergents.

Using polysaccharide microgels as a thickener for detergents. Using polysaccharide microgels as component for reducing surface tension on the interphase for detergents.

A detergent comprised of water, a range of surfactants and an antiresorption agent, different in that the antiresorption agent consists of polysaccharide microgels, and the following ratio takes place (mass %):

Combination of surface-active agents: 0.1-15
Polysaccharide microgels: 0.1-5
Water: balance A detergent consisting of water, a range of surfactants and a thickener, different in that the thickener consists of polysaccharide microgels with the following ratio of components, mass %:

A set of surface-active agents: 0.1-15
Polysaccharide microgels: 0.1-5
Water: balance A detergent consisting of water and a component that reduces surface tension at the interphase boundary, different in that the component which reduces the interphase surface tension contains polysaccharide microgels, and the ratio between the components is as follows (mass %):

Polysaccharide microgels: 0.1-5
Water: balance

Microgels represent branched polymer colloid particles of 0.1-1 μm diameter, that can swell considerably in a solvent due to electrostatic or steric repulsion between the charged functional groups. They form by directional polymerization of monomers or by pH-triggered neutralization of solutions of synthetic or natural polymers carrying carboxyl or amino groups.

Colloidal solutions of natural polysaccharides with 0.1-1 μm diameter can be regarded as polysaccharide microgels and their particles representing a gel with 90-99% water; low-substituted (<40%) carboxymethyl cellulose for example or its salts formed with aliphatic amines (butylamine, benzylamin, ethylene diamine, hexamethyl diamine), chitosan of 90-97% deacetylation and its salts with organic acids, pectin substances with residual quantity of metaxyl groups <25% and their salts with aliphatic amines (butylamine, benzylamine, ethylene diamine, hexamethyl diamine), modified starch or other substances capable of forming stable gels of submicron sizes.

To produce polysaccharide gels of greater stability, polymer chains of polysaccharides are chemically cross-linked, using anhydrides or activated ethers of dicarboxylic acids, di-isocyanides, di-isocyanates or other cross-linking agents. Polysaccharide microgels used in this cluster of inventions can also be produced by physical association.

Polysaccharide microgels can be modified with hydrophobic aggregates substituents, which can be represented by non-branched alkyl aggregates groups with C6-C18 chain length. Fatty acids of natural oils, such as coconut, soy, sunflower, rapeseed etc, can be used as raw material for non-branched alkyl groups with chains of C6-C18 length. Polysaccharide microgels modified with non-branching alkyl groups with chains of C6-C18 length are easily oxidized. Consequently, they are safest for ecology and people. Other hydrophobic groups can also be used, such as branched alkyl substitutes, aryl substitutes, residues of amino acids with two aliphatic substitutes etc. Preferably, polysaccharide microgels modified with hydrophobic aggregates should have substitution level of 5 to 50%. When substitution is less than 5% polysaccharide microgels might start displaying low surface activity. When substitution is above 50% the microgels might loose their water solubility, so that they are unlikely to be used in detergents. Polysaccharide microgels modified with hydrophobic aggregates groups are characterised by great surface activity, therefore they are preferable as thickeners or interphase tension reducing components surfactants. Unmodified polysaccharide microgels are mostly used as antiresorption agents. However, using polysaccharide microgels in detergents permits reducing concentration of surface-active agents in the detergents in both cases.

Polysaccharide microgels can be included in neutral, acid or alkaline detergents in combination with various surfactants. They also can be used as the base product for a detergent, while being surface-active. Combining polysaccharide microgels with surfactants, their selection should be based on composition of the surfactant. Microgels with a positively charged surface can be used in combination with cation surfactants, while those with a negatively charged surface, with anion or non-ionic surfactants. Polysaccharide microgels with carboxymethyl cellulose, starch or pectin can be used in combination with anion or non-ionic surfactants in neutral or acid conditions for example. On the other hand, polysaccharide microgels with chitosan-based amino groups can be used in combination with cation surfactants. On the whole, the rules for combining components in detergents are explainable by the negative effect demonstrated in the formation of insoluble deposits when mixing components carrying opposite charges of sign.

Total concentration of polysaccharide microgels calculated on a dry weight basis should be in the 0.1-5% range. Lower concentrations produce a weak antiresorption effect and surface activity, while at higher concentrations, the microgel might take over the entire volume of the detergent, making it far too viscous.

The aggregate of surfactants might include many varieties, such as anion, nonionic, cation and amphoteric surfactants. Such anion substances as sodium lauril-sulphate, alkyl sulfonic acid and its salts, salts of fatty acids, such nonionic substances as glycosides of diethenolamide of fatty acids of coconut oil, or oxyethylated fatty spirits, such cation substances as quaternary ammonium salts of fatty amines, betaines of fatty acids, acylcholines as well as other known surfacants can be used. Total concentration of surfacants in a detergent must not exceed 15% because higher concentrations present a potential hazard for the user.

Acids can include various organic and/or inorganic acids: acetic, ortho phosphoric, sulfamic or citric acid or some other acids.

Alkalis can include various organic or inorganic bases, such as caustic soda, aliphatic amines op other known alkalis.

Total concentration of acids and alkalis in detergents can vary in a very wide range, but usually falls into the 0.1 to 50% range. This range of concentrations ensures that the required concentration of acid or alkali or the required pH level is reached on diluting the detergent with water.

Detergents can contain various auxilary components, such as hydrotropic agents (urea, betaine, salts of benzoic, salicylic, phthalic, oxalic or sulfanilic acids, toluene sulfonic acids etc), organic solvents (ethanol, methoxyethanol, methoxypropanol), preservatives (methyl isothiazole, benzoic, sorbic acids, alkyl parabens), thickeners (sodium gluconate, polysilicate, salts of polyphosphates acids), dyes and aromatizes, permitted for use in food or cosmetic production.

The proposed cluster of inventions is characterized by new features, unknown state of the art technology, as polysaccharide microgels are proposed to be used in detergents as antiresorption agents, thickeners or agents to reduce interphase boundary tension. Polysaccharide microgels precipitate on the target surface, producing a stronger and thermodynamically stabilizing hydrophilic film, which prevents reprecipitation of hydrophobic by nature contaminants and hard particles. Moreover, since polysaccharide microgels have high affinity to hydrophobic contaminants they form a viscous film on their surface, which also prevents their re-precipitation on the cleaned surface. Polysaccharide microgels can also stabilize the air/water interphase boundary by producing stable foam; they also considerably increase viscosity of detergents by producing network-like structures in solutions.

Thanks to the above properties, polysaccharide microgels eliminate the necessity to introduce additional surfactants into detergents; they can be substituted for traditional surfactants, thus ensuring that the claimed technological goal is met, which is to reduce the quantity of surfactants in detergents, while preserving their detergency; also as polysaccharide microgels are safe for the environment and people, they improve ecological properties and safety of detergents. The above mentioned properties of polysaccharide microgels were not known to the state of the art technology as was using them as a base or an additive in detergents, thus precluding secondary contamination, producing good foaming and increasing viscosity of the detergent.

The above discussion suggests that the proposed cluster of inventions is novel and not obvious for an expert in the appropriate industrial field. Consequently this cluster of inventions meet the 'novelty' and 'invention level' patenting criteria.

The proposed cluster of inventions can allows using well-known materials and well-known production methods, which suggests that this cluster of patents meet the patenting criterion 'industrial applicability'.

The proposed cluster of inventions was tested in the laboratory. The test results are presented in Tables 1 and 2, and also in the examples of detergents where polysaccharide microgels were included as the base or an additive.

To receive objective data on the technological result achieved, compositions of known detergents, not containing polysaccharide microgels, were used as the basis for these experiments. Detergency of these detergents containing no polysaccharide microgels, was measured, then similar detergents were designed with a lower surfactant concentration, containing polysaccharide microgels as the base or an additive, with a similar detergency.

Measuring detergency of the detergents included preparation of a model contamination, representing a mixture of fats and hard particles of different nature, applying these contaminants to the surface, treating the contaminated surface with a 0.2% solution of the detergent under standard conditions, and measuring residual contamination by washing it off the surface with organic solvents.

Preparation of polysaccharide microgels included modifying original polysaccharides by hydrolysis, carboxymethylation, alkylation, acylation, ammonolysis, or hydrazinolysis or by reacting them with aliphatic amines, or by the Ugi reaction, or (in some cases) by chemical cross-linking of polysaccharides using their reactions with diethers, diamines, dialdehydes, di-isocyanides, di-isocyanates, di-isocyanides, genipin or other cross-linking reagents. Then the optimum pH, which ensures formation of microgel particles, was reached by adding either acid or alkaline solution.

Preparation of detergents in general included preparing a solution of surfactants in a deionised water, while simultaneously preparing a suspension of polysaccharide microgels, mixing the two with vigorous stirring, then adding acids, alkalis, preservatives, hydrotropic substances, chelating agents and other auxiliary components.

The proposed cluster of inventions is explained using the following examples.

EXAMPLE 1. DISH AND CUTLERY WASHING LIQUID (NEUTRAL PH)

Carboxylmethyl cellulose (CMC)-based microgel: 1% on dry weight basis, sodium laureth sulfate (coconut oil based): 4.5%, coconut diethanolamide (coconut oil based): 1.8%, table salt: 4%, a hydrotropic agent: 4%, preservative: 0.1%. Introduction of the microgel reduced the total concentration of anion and non-ionic surfactants from 10 to 6.3% without affecting detergency.

EXAMPLE 2. UNIVERSAL HOUSEHOLD LIQUID FOR EVERYDAY CLEANING (NEUTRAL PH)

Pectin ammonium salt-based microgel: 0.5% on dry weight basis, sodium alkyl benzosulfate: 4.0%, coconut diethanolamide (coconut oil based): 2.5%, a hydrotropic agent: 4%, preservative: 0.1%. This microgel reduced the total concentration of anion and non-ionic surfactant from 10 to 6.5% without affecting detergency.

EXAMPLE 3. HYPOALLERGENIC LIQUID SOAP (NEUTRAL PH)

Carboxymethylated starch-based microgel: 3% on dry weight basis, sodium laureth sulfate (coconut oil based): 3.5%, sodium alkyl benzosulfate: 1%, coconut diethanolamide (coconut oil based): 2.0%, glycerine: 2%, hydrotropic agent: 4%, preservative: 0.1%. This microgel decreased the total concentration of anion and non-ionic surfactant from 10 to 6.5% without affecting detergency.

EXAMPLE 4. FLOOR CLEANER (NEUTRAL PH)

Chitosan-based microgel: 0.1% on dry weight basis; hexadecyl trimethyl ammonium chloride: 4.0%; elotant CSAE120 (APG 8-10): 1.8%, preservative: 0.1%. This microgel reduced total concentration of anion and non-ionic surfactants from 10 to 5.8% without affecting detergency.

EXAMPLE 5. NEUTRAL LIQUID FOR GLASS AND MIRROR CLEANING (NEUTRAL PH)

Pectin-based microgel: 0.3% on dry weight basis, elotant CSAE120 (APG 8-10): 3.5%, preservative: 0.1%. This microgel reduced the total concentration of anion and non-ionic surfactants from 10 to 3.5% without affecting detergency.

EXAMPLE 6. CARPETS AND UPHOLSTERY CLEANER (NEUTRAL PH)

Carboxymethylated starch-based microgel: 1.5% on dry weight basis, sodium laureth sulfate (coconut oil based): 4.2%, coconut diethanolamide (coconut oil based): 2.1%, methoxypropanol: 5%, hydrotropic agent: 4%, preservative: 0.1%. This microgel reduced the total concentration of anion and non-ionic surfactants from 10 to 6.3% without affecting detergency.

EXAMPLE 7. PROFESSIONAL CLEANER FOR CERAMIC TILES (WEAKLY ACIDIC PH)

CMC-based microgel: 1% on dry weight basis; acetic acid: 12%; elotant CSAE (APG 8-10): 3.8%; coconut diethanolamide (coconut oil based): 1.0%, preservative: 0.1% This microgel reduced the total concentration of anion and non-ionic surfactants from 10 to 4.8% without affecting detergency.

EXAMPLE 8. ALKALINE CLEANER FOR KITCHEN STOVES (STRONGLY ALKALINE PH)

Chitosan-based microgel: 2% on dry weight basis, caustic soda: 15%, elotant Milcoside100 (APG 8-10): 2.0%, chelating agent: 0.2%. This microgel reduced the total concentration of anion and non-ionic surfactants from 5 to 2% without affecting detergency.

EXAMPLE 9. SANITARY WARE CLEANER (STRONGLY ACIDIC PH)

CMC-based microgel: 1% on dry weight basis; sulfamic acid: 10%, oxalic acid: 10%, ethoxyethylated spirit ethoxylated alcohols: 1.5%; preservative: 0.1%. This microgel reduced the total concentration of anion and non-ionic surfactants from 5 to 1.5% without affecting detergency.

EXAMPLE 10. PROFESSIONAL ACIDIC CLEANER (STRONGLY ACIDIC PH)

CMC-based microgel: 5% on dry weight basis, orthophosphoric acid: 10%, oxalic acid: 15%, etoxyethylated spirit ethoxylated alcohols: 0.5%, preservative: 0.1%. This microgel reduced the total concentration of anion and non-ionic surfactants from 2 to 0.5% without affecting detergency.

The proposed cluster of inventions is explained, using the following examples of detergents containing polysaccharide microgels modified with hydrophobic aggregates.

EXAMPLE 11. DISH AND CUTLERY WASHING LIQUID, COMPOSITION 1 (NEUTRAL PH)

Carboxymethyl cellulose (CMC) based microgel, modified with aliphatic substitutes C8; substitution 15.0%, concentration 1.0% on dry weight basis; sodium laureth sulfate (coconut oil based); 3.8%; coconut diethanolamide (coconut oil based): 1.7%; hydrotropic agent: 4.0%, preservative: 0.1%.

This microgel reduced the total concentration of anion and non-ionic surfactants from 10 to 5.5% and eliminated table salt from the composition, while not affecting detergency.

EXAMPLE 12. DISH AND CUTLERY WASHING LIQUID, COMPOSITION 2 (NEUTRAL PH)

Pectin-based microgel, modified with aliphatic substitutes based on coconut oil C8-C16, substitution 25.0%, concentration 0.5% on dry weight basis; sodium laureth sulfate (coconut oil based): 5.1%, coconut diethanolamide (coconut oil based): 2.0%, hydrotropic agent: 4.0%, preservative: 0.1%.

Addition of this microgel reduced total concentration of anion and non-ionic surface-active agents from 10 to 7.1% and eliminated table salt from the composition, while not affecting detergency.

EXAMPLE 13. HYPOALLERGENIC LIQUID SOAP (NEUTRAL PH)

Microgel based on starch modified with aliphatic substitutes, based on coconut oil C8-C18, substitution 50.0%, concentration 2.0% on dry weight basis, sodium alkylbenzosulphate: 1.2%, coconut diethanolamide (based on coconut oil): 1.8%, glycerine: 2.0%, hydrotropic substance: 4.0%, preservative: 0.1%. Addition of this microgel reduced the total concentration of anion and non-ionic surfactants from 10 to 3.0%, while not affecting detergency.

EXAMPLE 14. PROFESSIONAL CLEANER FOR CERAMIC TILES (WEAKLY ACID PH)

CMC-based microgel, modified with aliphatic substitutes C8, substitution 20.0%, concentration 0.3% on dry weight basis, acetic acid: 12.0%, elotant CSAE120 (APG 8-10): 4.2%, diethanolamide coconut diethanolamide (coconut oil based): 1.1%, preservative: 0.1%.

Addition of this microgel reduced total concentration of anion and non-ionic surfactants from 10 to 5.3% and eliminated table salt from the composition, while not affecting detergency.

EXAMPLE 15. ALKALINE CLEANER FOR CLEANING KITCHEN STOVES, COMPOSITION 1 (HIGHLY ALKALINE PH)

Chitasan-based microgel, modified with aliphatic substitutes C12, substitution 10.0%, concentration 0.1% on dry weight basis, caustic soda: 15.0%, elotant Milcoside (APG 8-10): 1.0%, chelating agent: 0.2%. Addition of this microgel reduced the total concentration of anion and non-ionic surfactants from 5.0 to 1.0% and eliminate thickening from the composition, while not affecting detergency.

EXAMPLE 16. ALKALINE DETERGENT FOR CLEANING KITCHEN HOBS, COMPOSITION 2 (VERY ALKALINE PH)

Pectin-based microgel, modified with aliphatic substitutes C8, substitution 15.0%, concentration 0.8% calculated for dry weight; caustic soda: 15.0%; elotant Milcoside100 (APG 8-10): 1.2%, chelating agent: 0.2%. Addition of this microgel reduced total concentration of anion and non-ionic surfactants from 5.0 to 1.2% and eliminated thickener from the composition, while not affecting detergency.

EXAMPLE 17. SANITARY WARE CLEANER, COMPOSITION 1 (HIGHLY ACID PH)

CMC-based microgel, modified with branched aliphatic substitutes based on oil processing products C8-C16, substitution 30.0%, concentration 2.0% on dry weight basis, sulfamic acid: 10.0%, preservative: 0.1%. Addition of this microgel eliminates all anion and non-ionic surfactants and thickeners, while not affecting detergency.

EXAMPLE 18. SANITARY WARE CLEANING GEL, COMPOSITION 2 (STRONGLY ACID PH)

Chitosan-based microgel, modified with aryl substitutes Ph, substitution 20.0%, concentration: 1.5% on dry weight basis; sulfamic acid: 10.0%, oxalic acid: 10.0%, preservative: 0.1%. Addition of this microgel eliminates all anion and non-ionic surfactants and thickeners, while not affecting detergency.

TABLE 1

Detergents, containing polysaccharide microgels, nonmodified by hydryphobic aggregates

| No. | Polysaccharide | Concentration of polysaccharide microgels | Concentration of surfactants, no microgels used | Concentration of surfactants, microgels used | Acid/alkali concentration | Use |
|---|---|---|---|---|---|---|
| 1 | CMC | 1% | 10% | 6.3% | neutral | Dish wash |
| 2 | Ammonium pectate | 0.5% | 10% | 6.5% | neutral | Cleaning |
| 3 | Carboxymethylated starch | 3% | 10% | 6.5% | neutral | Hand wash |
| 4 | Chitosan | 0.1% | 10% | 5.8% | neutral | Floor cleaner |

TABLE 1-continued

Detergents, containing polysaccharide microgels, nonmodified by hydryphobic aggregates

| No. | Polysaccharide | Concentration of polysaccharide microgels | Concentration of surfactants, no microgels used | Concentration of surfactants, microgels used | Acid/alkali concentration | Use |
|---|---|---|---|---|---|---|
| 5 | Pectin | 0.3% | 10% | 3.5% | neutral | Glass cleaner |
| 6 | Carboxylmethylated starch | 1.5% | 10% | 6.3% | neutral | Carpet cleaner |
| 7 | CMC | 1% | 10% | 4.8% | weakly acid | Ceramic tiles cleaner |
| 8 | Chitosan | 2% | 5% | 2.0% | strongly alkaline | Kitchen cleaner |
| 9 | CMC | 1% | 5% | 1.5% | strongly acidic | Sanitary ware cleaner |
| 10 | CMC | 5% | 2% | 0.5% | strongly acidic | Sanitary ware cleaner |

TABLE 2

Detergents containing polysaccharide microgels modified with hydrophobic aggregates

| No. | Polysacharide | Hydrophobic aggregates | Substitution | Macrogel concentration | Surfactant concentration, no microgels used | Surfactant concentration, microgels used | Alkali/acid concentration | Commentary |
|---|---|---|---|---|---|---|---|---|
| 11 | CMC | C8 | 15.0 | 1.0 | 10.0 | 5.5 | neutral | Dish wash |
| 12 | Pectin | C8-C16 | 25.0 | 0.5 | 10.0 | 7.1 | neutral | Dish wash |
| 13 | Starch | C8-C16 | 50.0 | 2.0 | 10.0 | 3.0 | neutral | Hand wash |
| 14 | CMC | C8 | 20.0 | 0.3 | 10.0 | 5.3 | weakly acid | Ceramic tiles cleaner |
| 15 | Chitosan | C12 | 10.0 | 0.1 | 10.0 | 1.0 | alkaline | Kitchen cleaner |
| 16 | Pectin | C8 | 15.0 | 0.8 | 5.0 | 1.2 | alkaline | Kitchen cleaner |
| 17 | CMC | Branched C8-C16 | 30.0 | 2.0 | 3.0 | 0 | strongly acidic | Sanitary ware cleaner |
| 18 | Chitosan | Ph | 20.0 | 1.5 | 3.0 | 0 | strongly acidic | Sanitary ware cleaner |

The invention claimed is:

1. A detergent comprising water, at least one surfactant, and at least one cross-linked polysaccharide microgel, wherein the at least one polysaccharide microgel is at least one microgel based on modified starch, pectin, chitosan, or combinations thereof, and wherein the total concentration of surfactants in the detergent is from 0.1% to 15% by mass, and the total concentration of cross-linked polysaccharide microgels in the detergent is from 0.1 to 5% by mass.

2. The detergent of claim 1, wherein the detergent further comprises a range of acids constituting 0.1-50 mass % of the detergent.

3. The detergent of claim 1, wherein the detergent further comprises a range of alkalis constituting 0.1-50 mass % of the detergent.

4. The detergent of claim 1, wherein the at least one surfactant is an anionic surfactant.

5. The detergent of claim 1, wherein the at least one surfactant is a nonionic surfactant.

6. The detergent of claim 1, wherein the at least one surfactant comprises at least two surfactants, comprising an anionic surfactant and a nonionic surfactant.

7. The detergent of claim 1, further comprising a hydrotropic agent.

8. The detergent of claim 1, further comprising an organic solvent.

9. The detergent of claim 1, further comprising a thickener.

10. The detergent of claim 1, further comprising a dye or aroma.

11. The detergent of claim 1, wherein the at least one cross-linked polysaccharide microgel is based on modified starch.

12. The detergent of claim 1, wherein the at least one cross-linked polysaccharide microgel is based on pectin.

13. The detergent of claim 1, wherein the at least one cross-linked polysaccharide microgel is based on chitosan.

14. The detergent of claim 1, wherein the at least one cross-linked polysaccharide microgel is formed by chemical cross-linking of polysaccharide with a diether, diamine, dialdehyde, di-isocyanide, di-isocyanate or genipin cross-linking agent.

15. The detergent of claim 1, wherein the at least one cross-linked polysaccharide microgel is modified with hydrophobic substituents.

16. The detergent of claim 15, wherein the at least one cross-linked polysaccharide microgel is modified with hydrophobic substituents at a substitution level of between 5% to 50%.

17. The detergent of claim 11, wherein the modified starch is modified with hydrophobic substituents.

18. The detergent of claim 12, wherein the pectin is modified with hydrophobic substituents.

19. The detergent of claim 13, wherein the chitosan is modified with hydrophobic substituents.

* * * * *